US011094257B2

(12) United States Patent
Hu et al.

(10) Patent No.: US 11,094,257 B2
(45) Date of Patent: Aug. 17, 2021

(54) PIXEL DRIVING CIRCUIT, PIXEL DRIVING METHOD AND DISPLAY APPARATUS

(71) Applicants: HEFEI XINSHENG OPTOELECTRONICS TECHNOLOGY CO., LTD., Anhui (CN); BOE TECHNOLOGY GROUP CO., LTD., Beijing (CN)

(72) Inventors: Qi Hu, Beijing (CN); Hui Jing, Beijing (CN); Weijing Liao, Beijing (CN)

(73) Assignees: Hefei Xinsheng Optoelectronics Technology Co., Ltd., Anhui (CN); BOE Technology Group Co., Ltd., Beijing (CN)

( * ) Notice: Subject to any disclaimer, the term of this patent is extended or adjusted under 35 U.S.C. 154(b) by 178 days.

(21) Appl. No.: 16/328,936

(22) PCT Filed: Jun. 22, 2018

(86) PCT No.: PCT/CN2018/092300
§ 371 (c)(1),
(2) Date: Feb. 28, 2019

(87) PCT Pub. No.: WO2019/056818
PCT Pub. Date: Mar. 28, 2019

(65) Prior Publication Data

US 2020/0410925 A1 Dec. 31, 2020

(30) Foreign Application Priority Data

Sep. 21, 2017 (CN) ..... 201710860876.7

(51) Int. Cl.
*G09G 3/3275* (2016.01)
*G09G 3/325* (2016.01)

(52) U.S. Cl.
CPC ..... *G09G 3/325* (2013.01); *G09G 3/3275* (2013.01); *G09G 2300/043* (2013.01)

(58) Field of Classification Search
CPC ..... G09G 3/32; G09G 3/325; G09G 3/3275
See application file for complete search history.

(56) References Cited

U.S. PATENT DOCUMENTS

2015/0310806 A1* 10/2015 Hu ..... G09G 3/3266 345/78
2016/0379553 A1 12/2016 Cho et al.
2017/0069270 A1* 3/2017 Hyeon ..... G09G 3/3216

FOREIGN PATENT DOCUMENTS

CN 103927990 A 7/2014
CN 104599638 A 5/2015
CN 204808833 U 11/2015

OTHER PUBLICATIONS

First Office Action for CN Application No. 201710860876.7, dated Nov. 5, 2018.

* cited by examiner

*Primary Examiner* — Alexander Eisen
*Assistant Examiner* — Cory A Almeida
(74) *Attorney, Agent, or Firm* — The Webb Law Firm

(57) ABSTRACT

The embodiments of the present disclosure disclose a pixel driving circuit, a pixel driving method and a display apparatus. A pixel driving circuit for driving a light emitting element, comprising: a first control sub-circuit providing a data signal terminal signal to a first node based on a first signal control terminal signal; a second control sub-circuit providing a first power source terminal signal to a fourth node based on a third signal control terminal signal, and a signal of the fourth node to a second node based on a second signal control terminal signal; a third control sub-circuit providing a second power source terminal signal to a third (Continued)

node based on a fourth signal control terminal signal; an energy storage sub-circuit storing a potential difference between the first node and the second node; and a driving sub-circuit transmitting a driving current for driving the light-emitting element.

13 Claims, 7 Drawing Sheets

PIXEL DRIVING CIRCUIT, PIXEL DRIVING METHOD AND DISPLAY APPARATUS

CROSS-REFERENCE TO RELATED APPLICATIONS

This application is a National Stage of International Application No. PCT/CN2018/092300, filed on Jun. 22, 2018, which claims priority to Chinese Patent Application No. 201710860876.7, filed on Sep. 21, 2017. Both of the aforementioned applications are hereby incorporated by reference in their entireties.

TECHNICAL FIELD

Embodiments of the present disclosure relate to the field of display technologies, and in particular, to a pixel driving circuit, a pixel driving method, and a display apparatus.

BACKGROUND

An Organic Light Emitting Diode (OLED) display is one of the hotspots in the field of display research today. Compared with liquid crystal display (LCD), OLED display has benefits such as low energy consumption, low production cost, self-illumination, wide viewing angle, fast response, etc.

SUMMARY

According to an aspect of the present disclosure, there is provided a pixel driving circuit for driving a light emitting element, comprising: a first control sub-circuit configured to provide a signal of a data signal terminal to a first node under the control of a first signal control terminal; a second control sub-circuit configured to provide a signal of a first power source terminal to a fourth node under the control of a third signal control terminal, and to provide a signal of the fourth node to a second node under the control of a second signal control terminal; a third control sub-circuit configured to provide a signal of a second power source terminal to a third node under the control of a fourth signal control terminal; an energy storage sub-circuit configured to store a potential difference between the first node and the second node; and a driving sub-circuit configured to transmit a driving current for driving the light-emitting element from a fourth node to the third node under the control of the second node.

Optionally, the first control sub-circuit may comprises: a first switching transistor, a gate electrode of the first switching transistor may be connected to the first signal control terminal, a first electrode of the first switching transistor may be connected to the data signal terminal, and the second electrode of the first switching transistor may be connected to the first node.

Optionally, the second control sub-circuit may comprise: a second switching transistor and a third switching transistor, a gate electrode of the second switching transistor may be connected to the second signal control terminal, a first electrode of the second switching transistor may be connected to the second node, and a second electrode of the second switching transistor may be connected to the fourth node, and a gate electrode of the third switching transistor may be connected to the third signal control terminal, a first electrode of the third switching transistor may be connected to the first power source terminal, and a second electrode of the third switching transistor may be connected to the fourth node.

Optionally, the third control sub-circuit may comprise: a fourth switching transistor, and a gate electrode of the fourth switching transistor may be connected to the fourth signal control terminal, a first electrode of the fourth switching transistor may be connected to the third node, and a second electrode of the fourth switching transistor may be connected to the second power source terminal.

Optionally, the energy storage sub-circuit may comprise: a capacitor, and one terminal of the capacitor may be connected to the first node, and the other terminal of the capacitor may be connected to the second node.

Optionally, the driving sub-circuit may comprise: a driving transistor, and a gate electrode of the driving transistor may be connected to the second node, a source electrode of the driving transistor may be connected to the third node, and a drain electrode of the driving transistor may be connected to the fourth node.

Optionally, the capacitor may be configured to adjust a potential of the second node by discharging until the potential of the second node is equal to a threshold voltage of the driving transistor.

Optionally, the light emitting element may be an organic light emitting diode.

Optionally, the first switching transistor, the second switching transistor, the third switching transistor, the fourth switching transistor, and the driving transistor may all be N-type thin film transistors or P-type thin film transistors.

Optionally, in a resetting stage, an input signal of the first signal control terminal, an input signal of the second signal control terminal, an input signal of the third signal control terminal, and an input signal of the fourth signal control terminal may all be at a high level; in a threshold detection stage, the input signal of the first signal control terminal, the input signal of the second signal control terminal and the input signal of the fourth signal control terminal may all be at the high level; in a writing stage, the input signal of the first signal control terminal and the input signal of the data signal terminal may both be at the high level; in the light emitting stage, the input signal of the third signal control terminal may be at the high level.

According to a further aspect of the present disclosure, there is provided a display apparatus comprising the pixel driving circuit as described above according to the present disclosure.

According to a still further aspect of the present disclosure, there is provided a pixel driving method for the above pixel driving circuit, comprising: in a reset stage, the first control sub-circuit providing the signal of the data signal terminal to the first node under the control of the first signal control terminal; the second control sub-circuit providing the signal of the first power source terminal to the fourth node under the control of the third signal control terminal, and providing the signal of the fourth node to the second node under the control of the third signal control terminal; the third control sub-circuit providing the signal of the second power source terminal to the third node under the control of the fourth signal control terminal; in a threshold detection stage, the third control sub-circuit providing the signal of the second power source terminal to the third node under the control of the fourth signal control terminal; and detecting the threshold voltage of the driving sub-circuit under the action of the energy storage sub-circuit; in a writing stage, the first control sub-circuit providing the signal of the data signal terminal to the first node under the control of the first signal control terminal; and in a light emitting stage, the second control sub-circuit providing the signal of the first power source terminal to the fourth node according to the control of the third signal control terminal, and the driving sub-circuit providing the driving current for driving the light emitting element from the fourth node to the third node under the control of the second node.

Optionally, the step of detecting the threshold voltage of the driving sub-circuit under the action of the energy storage sub-circuit may comprise: the energy storage sub-circuit adjusts the potential of the second node by discharging until the potential of the second node is equal to the threshold voltage of the driving transistor in the driving sub-circuit.

Optionally, in the threshold detection stage, the potential of the fourth node may be equal to the potential of the second node.

BRIEF DESCRIPTION OF THE DRAWINGS

The drawings are used to provide a further understanding of the technical solutions of the present disclosure, constitute a part of the specification, are used to explain the technical solutions of the present disclosure with the embodiments of the present disclosure, and do not constitute a limitation of the technical solutions of the present disclosure.

DETAILED DESCRIPTION

In order to make the purpose, technical solution and benefits more clear, the embodiments of the present disclosure will be described in detail below with reference to the accompanying drawings. It should be noted that, in the case of no conflict, the embodiments in the present application and the features in the embodiments may be arbitrarily combined with one another.

Those skilled in the art should understand that the switching transistor and the driving transistor used in all embodiments of the present application may be thin film transistors or field effect transistors or other devices having similar characteristics. Preferably, the thin film transistor used in the embodiment of the present disclosure may be an oxide semiconductor transistor. Since the source and drain of the switching transistor used here are symmetrical, the source and the drain can be interchanged. In the embodiments of the present disclosure, in order to distinguish the two electrodes of the switching transistor beside the gate, one of the electrodes is referred to as a first electrode, the other electrode is referred to as a second electrode. The first electrode may be a source or a drain, and the second electrode can be a drain or a source.

The pixel driving circuit is the core technology of the OLED display. In the OLED display, the pixel driving circuit needs to detect a threshold voltage of a driving transistor, in order to output a stable current to control light emission of the OLED.

According to the research by the inventors, the prior pixel driving circuit ignores the parasitic capacitance of the OLED, so that the detection result of the threshold voltage of the driving transistor is not accurate and the detection time is too long.

Figure 1:
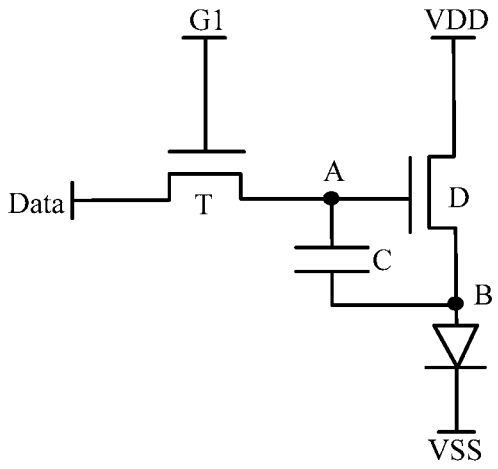
FIG. 1 is an equivalent circuit diagram of a conventional pixel driving circuit.

FIG. 1 is an equivalent circuit diagram of a conventional pixel driving circuit. As shown in FIG. 1, a conventional pixel driving circuit adopts 2T1C configuration, that is, being composed of one driving transistor D, one switching transistor T, and one capacitor C. The pixel driving circuit is configured to drive the organic light emission diode (OLED). A drain of the driving transistor D is connected to a first power source terminal VDD, a source is connected to a second node B, a gate is connected to a first node A, and a gate of a switching transistor T is connected to the signal control terminal G1. The first electrode of the switching transistor T is connected to a data signal terminal Data, the second electrode of the switching transistor T is connected to the first node A. One terminal of the capacitor C is connected to the first node A, and the other terminal of the capacitor C is connected to the second node B. One terminal of the organic light emitting diode (OLED) is connected to the second node B, and the other terminal of the OLED is connected to the second power source terminal VSS.

The specific working process includes following steps. Under the control of the signal control terminal G1, the switching transistor T is turned on, and the signal of the data signal terminal Data is provided to the first node A. At this time, the potential of the first node A is $V_A=V_{ref}$. At a threshold detection stage, under the control of the signal control terminal G1, the switching transistor T is turned off. At this time, the capacitor C is discharged until the potential of the second node B is $V_B=V_A-V_{th}$. In a writing stage, signals of the data signal terminal Data are provided to the first node A. At this time, the potential of the first node A is $V_A=V_{data}$. At this time, the voltage difference between the gate and source of the driving transistor D is $V_{GS}=V_A-V_B=V_{data}-V_{ref}+V_{th}$, greater than the threshold voltage $V_{th}$ of the driving transistor D. Therefore, the driving transistor D is turned on, and a current flows through the organic light emitting diode (OLED) so that the organic light emitting diode (OLED) emits light.

According to the research by the inventors, during the above process, due to the parasitic capacitance of the organic light emitting diode (OLED), in the threshold detection stage when the source voltage of the driving transistor D (i.e., the VB) is rising, the parasitic capacitance of the organic light emitting diode (OLED) is charged simultaneously. This cause the result of detecting the threshold of the driving transistor is not accurate, and the detection time is too long.

To this end, embodiments of the present disclosure provide a pixel driving circuit, a pixel driving method, and a display apparatus.

A pixel driving circuit according to some embodiments of the present disclosure includes: a first control sub-circuit for providing a signal of a data signal terminal to a first node under control of a first signal control terminal; a second control sub-circuit for providing a signal of a first power source terminal to a fourth node under control of a third signal control terminal, and for providing a signal of the fourth node to a second node under control of a second signal control terminal; a third control sub-circuit for providing a signal of a second power source terminal under control of a fourth signal control terminal; an energy storage sub-circuit for storing the potential between the first node and the second node; and a driving sub-circuit for sending the driving current for driving the light-emitting element to the third node under control of the second node and the fourth node. In the embodiment of the present disclosure, the third control sub-circuit provides the signal of the second power source terminal to the third node during the threshold detection stage, and the light emitting element is short circuited. This eliminates the technical problem that the result of the threshold voltage detection is not accurate and the detection time is too long which are caused by the parasitic capacitance of the light-emitting element. The accuracy of the result of the threshold detection is improved, and the time required for detecting the threshold voltage is reduced.

Of course, implementing any of the products or methods of the present disclosure does not necessarily have all of the advantages described above at the same time. Other features and advantages of the present disclosure will be set forth in the embodiments of the specification, and a part of them become clear from the embodiments of the specification or become understood by implementing the present disclosure. The objectives and other advantages of the embodiments of the present disclosure can be realized and obtained by the structure particularly pointed out in the specification, claims and drawings.

Figure 2:
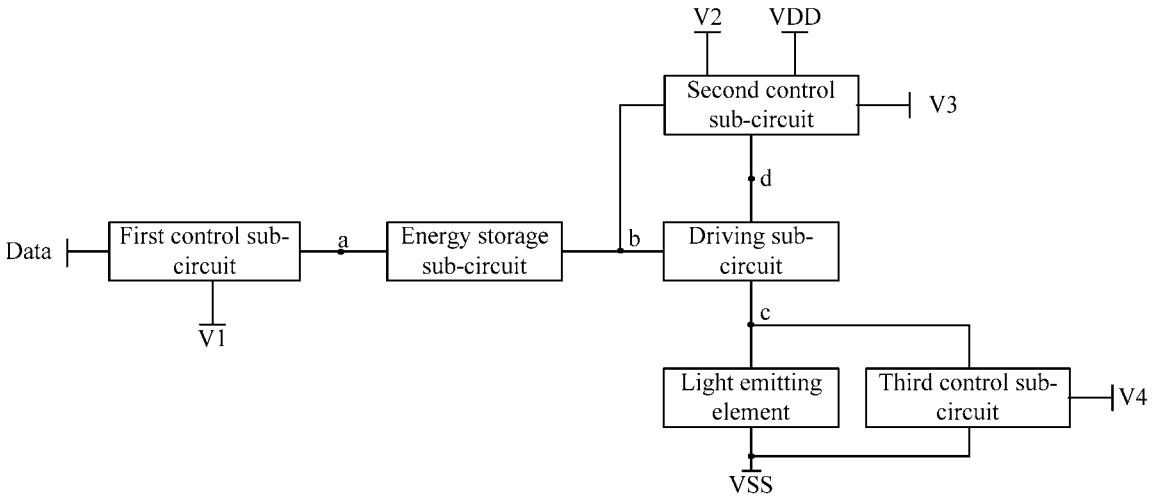
FIG. 2 is a structural block diagram of a pixel driving circuit according to an embodiment of the present disclosure.

FIG. 2 is a schematic structural diagram of a pixel driving circuit according to an embodiment of the present disclosure. As shown in FIG. 2, a pixel driving circuit provided by an embodiment of the present disclosure is configured to drive a light emitting component, and includes: a first control sub-circuit, a second control sub-circuit, a third control sub-circuit, an energy storage sub-circuit, and a driving sub-circuit.

In this embodiment, the first control sub-circuit is respectively connected to a data signal terminal Data, a first signal control terminal V1 and a first node a, and is configured to provide a signal of the data signal terminal Data under control of the first signal control terminal V1. The second control sub-circuit is respectively connected to a second node b, a fourth node d, a second signal control terminal V2, a third signal control terminal V3 and a first power source terminal VDD, and is configured to provide the signal of the first power source terminal VDD to the fourth node d under the control of the third signal control terminal V3, and is further configured to provide the signal of the fourth node d to the second node b under the control of the second signal control terminal V2. The third control sub-circuit is respectively connected to a third node c, a fourth signal control terminal V4 and a second power source terminal VSS, and is configured to provide a signal of the second power source terminal VSS to the third node c under the control of the fourth signal control terminal V4. The energy storage sub-circuit is respectively connected to the first node a and the second node b, and is configured to store the potential between the first node a and the second node b. The driving sub-circuit is respectively connected to the second node b, the third node c and the fourth node d, and is configured to send driving current for driving the light emitting element from fourth node d to the third node c under the control of the second node b.

In this embodiment, the light emitting element may be an organic light emitting diode (OLED) having an anode connected to the third node c and a cathode connected to the second power source terminal VSS.

It should be noted that the potential $V_{dd}$ of the first power source terminal VDD continues to be at a high level, and the potential $V_{ss}$ of the second power source terminal VSS continues to be at a low level. The potential of the first power source terminal VDD may be 5V or more, and the potential of the second power source terminal VSS is smaller than the potential of the first power source terminal VDD.

Figure 4:
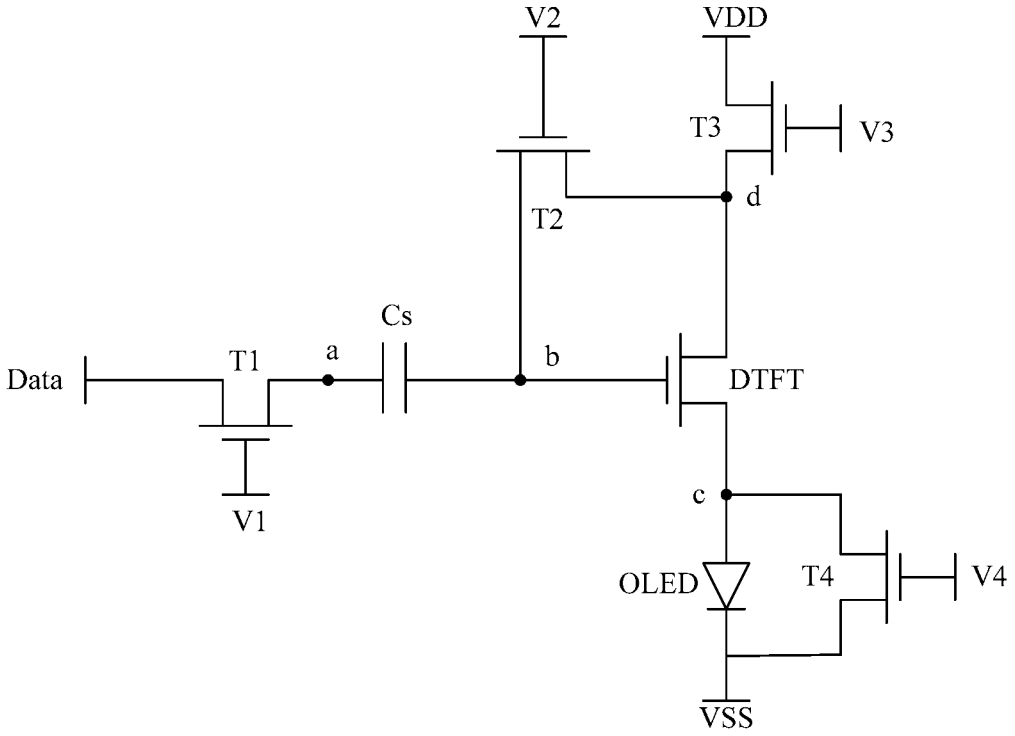
FIG. 4 is an equivalent circuit diagram of a pixel driving circuit according to some embodiments of the present disclosure.

FIG. 4 is an equivalent circuit diagram of a pixel driving circuit according to some embodiments of the present disclosure. FIG. 4 specifically shows exemplary structures of the first control sub-circuit, the second control sub-circuit, the third control sub-circuit, the energy storage sub-circuit and the driving sub-circuit. Those skilled in the art will readily understand that the implementation of the above sub-circuits is not limited thereto and may be in many ways as long as their respective functions can be realized.

As shown in FIG. 4, in the pixel driving circuit according to the embodiment of the present disclosure, the first control sub-circuit includes a first switching transistor T1. A gate of the first switching transistor T1 is connected to the first signal control terminal V1, a first electrode of the first switching transistor T1 is connected to the data signal terminal Data, and the second electrode of the first switching transistor T1 is connected to the first node a.

The second control sub-circuit comprises a second switching transistor T2 and a third switching transistor T3. A gate of the second switching transistor T2 is connected to the second signal control terminal V2, a first electrode of the second switching transistor T2 is connected to the second node b, and the second electrode of the second switching transistor T2 is connected to the fourth node d. A gate of the third switching transistor T3 is connected to the third signal control terminal V3, the first electrode of the third switching transistor T3 is connected to the first power source terminal VDD, and the second electrode of the third switching transistor T3 is connected to the fourth node d.

The third control sub-circuit includes a fourth switching transistor T4. A gate of the fourth switching transistor T4 is connected to the fourth signal control terminal V4, the first electrode of the fourth switching transistor T4 is connected to the third node c, and the second electrode of the fourth switching transistor T4 is connected to the second power source terminal VSS.

The energy storage sub-circuit includes a capacitor Cs. One terminal of the capacitor Cs is connected to the first node a, and the other terminal of the capacitor Cs is connected to the second node b.

The driving sub-circuit includes a driving transistor DTFT. A gate of the driving transistor DTFT is connected to the second node b, a source electrode of the driving transistor DTFT is connected to the third node c, and a drain electrode of the driving transistor DTFT is connected to the fourth node d.

In the present embodiment, the capacitor Cs is specifically configured to adjust the potential of the second node b by discharging until the potential of the second node b is the threshold voltage $V_{th}$ of the driving transistor DTFT.

Specifically, in a reset stage, an input signal of the first signal control terminal V1, an input signal of the second signal control terminal V2, an input signal of the third signal control terminal V3, and an input signal of the fourth signal control terminal V4 are all at a high level. In the threshold detection stage, the input signal of the first signal control terminal V1, the input signal of the second signal control terminal V2, and the input signal of the fourth signal control terminal V4 are all at the high level. In the writing stage, the input signal of the first signal control terminal V1 and the input signal of the digital signal terminal are both at the high level. In the light emitting stage, the input signal of the third signal control terminal V3 is at the high level.

It should be noted that, in this embodiment, the driving transistor DTFT, the first switching transistor T1, the second switching transistor T2, the third switching transistor T3, and the fourth switching transistor T4 may each be an N-type thin film transistor or a P-type thin film transistor. The process can be unified, and the process of the OLED display can be reduced, which helps to improve the yield of the product.

Next, the technical solution of the embodiment of the present disclosure is further illustrated by the working process of the pixel driving circuit.

Figure 3:
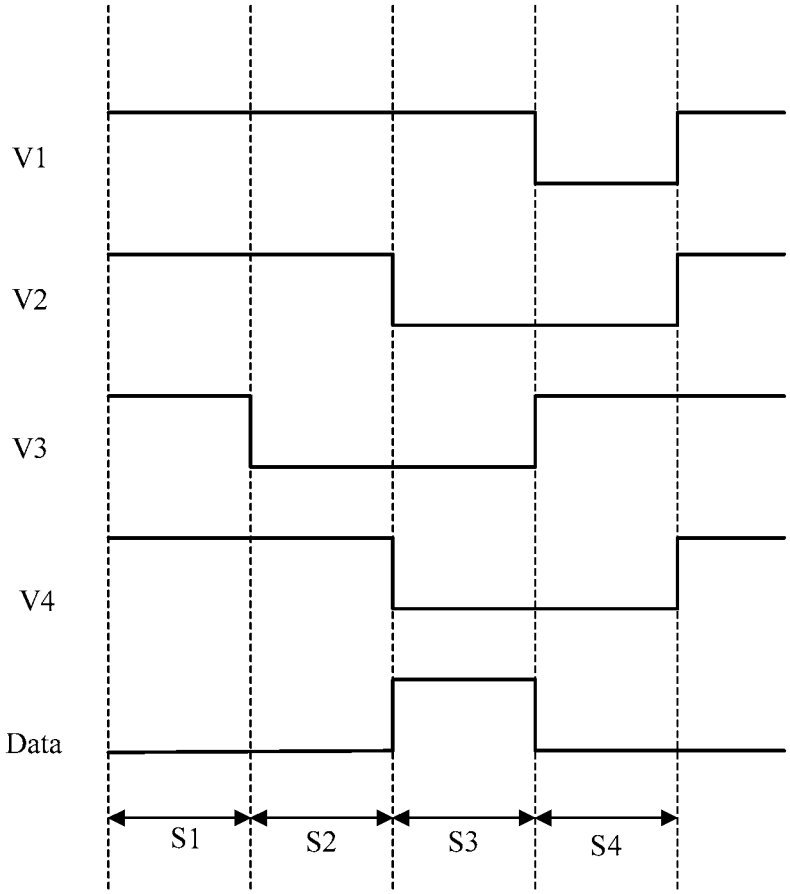
FIG. 3 is an operational timing diagram of a pixel driving circuit according to some embodiments of the present disclosure.
Figure 5A:
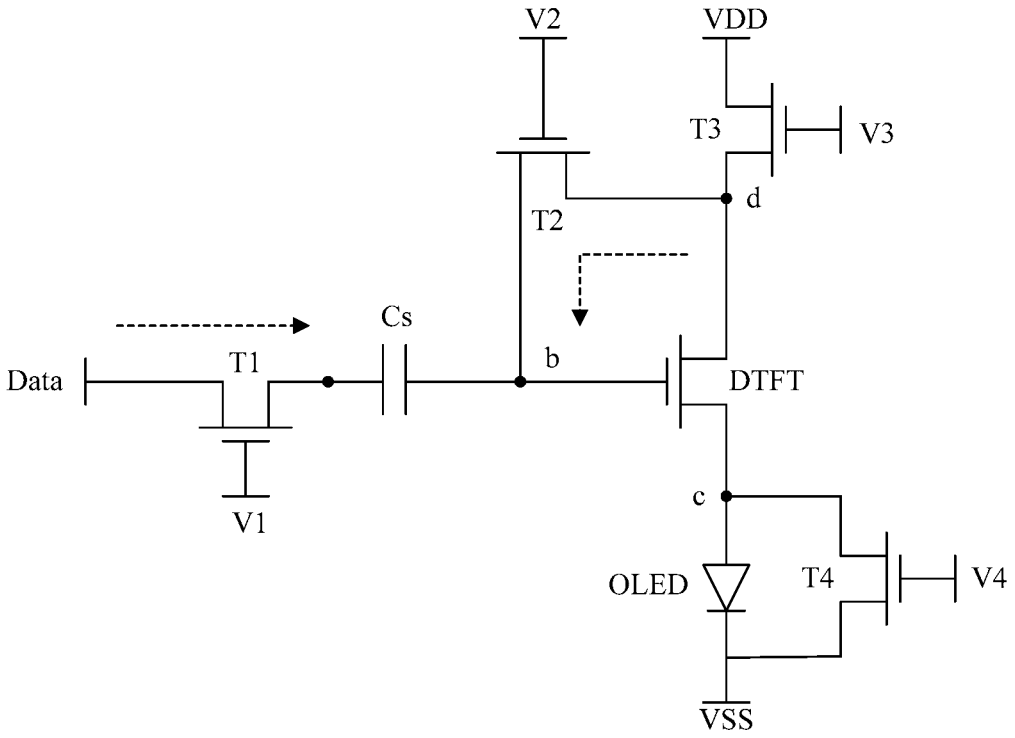
FIG. 5A is a diagram showing an operational state of a pixel driving circuit in a first stage according to some embodiments of the present disclosure.
Figure 5B:
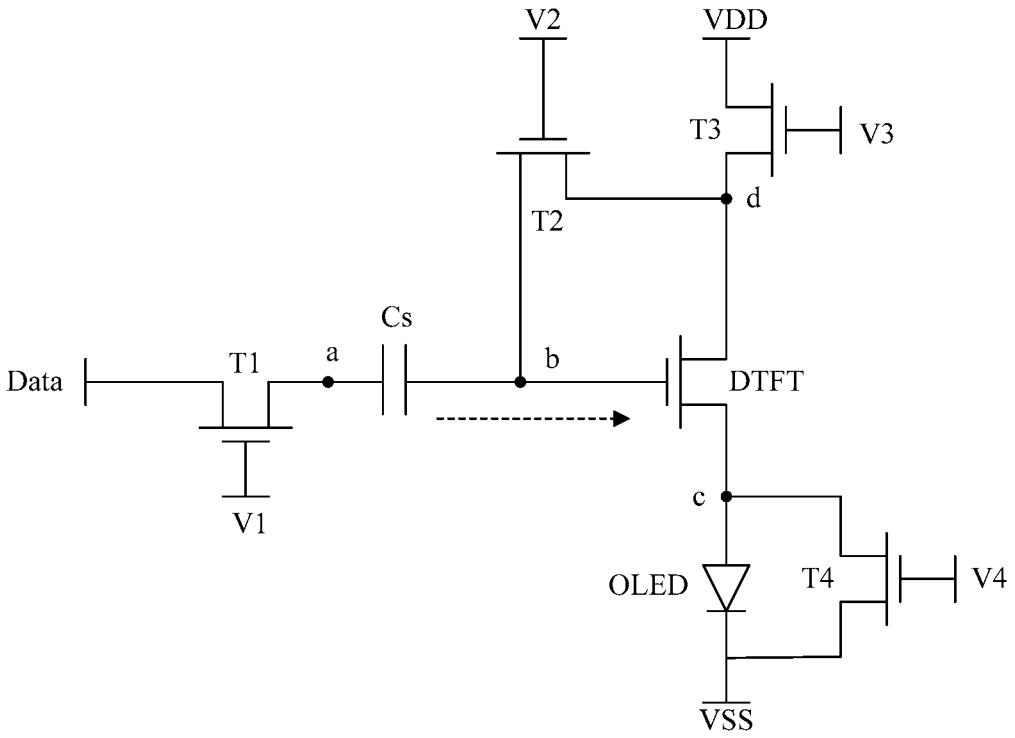
FIG. 5B is a diagram showing an operational state of a pixel driving circuit in a second stage according to some embodiments of the present disclosure.
Figure 5C:
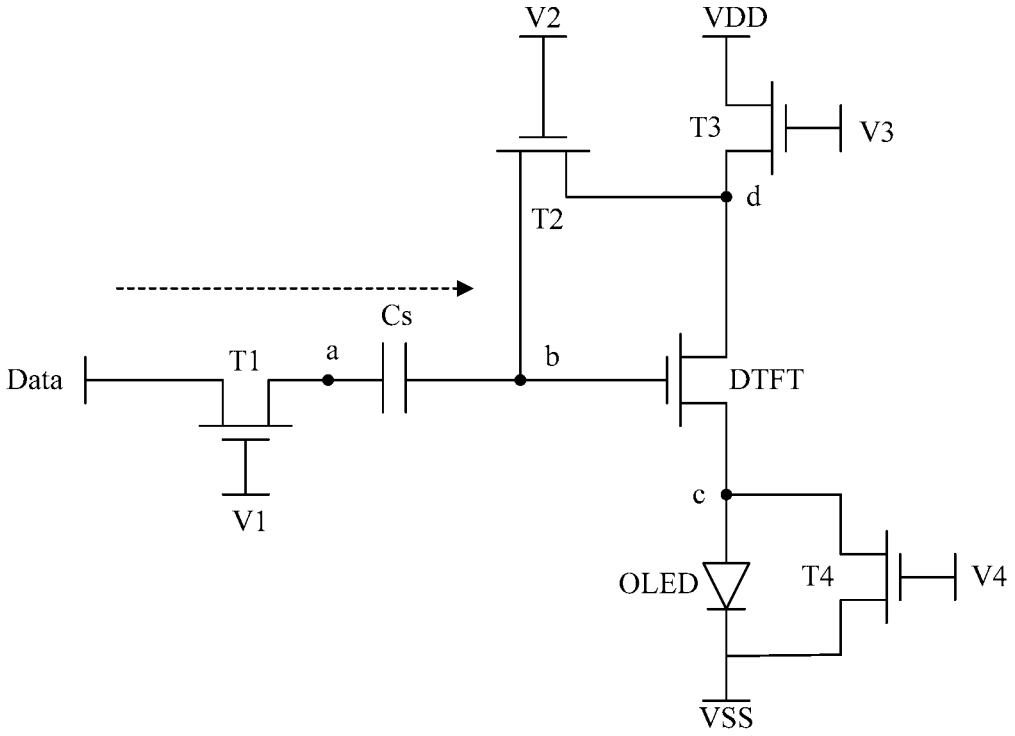
FIG. 5C is a diagram showing an operational state of a pixel driving circuit in a third stage according to some embodiments of the present disclosure.
Figure 5D:
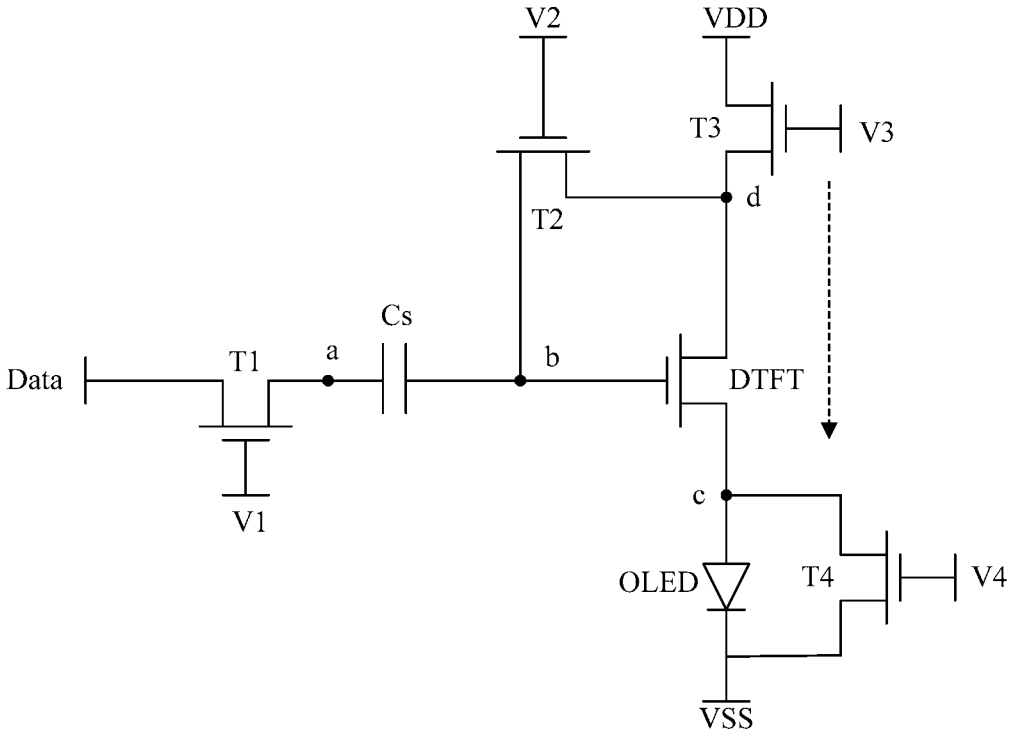
FIG. 5D is a diagram showing an operational state of a pixel driving circuit in a fourth stage according to some embodiments of the present disclosure.

FIG. 3 is an operation timing diagram of a pixel driving circuit according to an embodiment of the present disclosure; FIG. 5A is a working state diagram of a pixel driving circuit at a first stage according to an embodiment of the present disclosure; FIG. 5B is a working state diagram of a pixel driving circuit at a second stage according to an embodiment of the present disclosure; FIG. 5C is a working state diagram of a pixel driving circuit at a third stage according to an embodiment of the present disclosure; FIG. 5D is a working state diagram of a pixel driving circuit at a fourth stage according to an embodiment of the present disclosure. As shown in FIG. 3 and FIG. 4, the pixel driving circuit provided by the embodiment of the present disclosure includes: four switching transistors (T1 to T4), one driving transistor (DTFT), one capacitor unit (Cs), and seven input terminals (Data, VDD, VSS, V1, V2, V3, and V4). Its working process includes:

The first stage S1, that is, the reset stage: the input signal of the first signal control terminal V1, the input signal of the second signal control terminal V2, the input signal of the third signal control terminal V3, and the input signal of the fourth signal control terminal V4 are all at a high level.

As shown in FIG. 5A, the first switching transistor T1, the second switching transistor T2, the third switching transistor T3, and the fourth switching transistor T4 are turned on. The signal of the data signal terminal Data is provided to the first node a under the control of the first signal control terminal V1. At this time, the potential $V_a$ of the first node a is 0. The signal of the first power source terminal VDD is provided to the fourth node d under the control of the third signal control terminal V3. At this time, the potential $V_d$ of the fourth node is equal to $V_{dd}$. The signal of the fourth node is provided to the second node b under the control of the second signal control terminal V2. At this time, the potential $V_b$ of the second node b is $V_b=V_d=V_{dd}$. The signal of the second power source terminal VSS is supplied to the third node c under the control of the fourth signal control terminal V4. At this time, the potential $V_c$ of the third node is equal to $V_{ss}$. Thereafter, the capacitor Cs maintains the difference between the potentials of the first node a and the second node b. Since $V_b$ is at a high level, the driving transistor DTFT is turned on, and since the capacitance Cs can maintain the difference between the potentials of the first node a and the second node b, the driving transistor DTFT is turned on at the beginning of the next stage, preparing for performing the threshold detection.

In this stage, the fourth switching transistor T4 is turned on to short-circuit the organic light emitting diode (OLED), and the organic light emitting diode (OLED) does not emit light even if the third switching transistor T3 and the driving transistor DTFT are turned on.

The second stage S2, that is, the threshold detection stage: the input signal of the first signal control terminal V1, the input signal of the second signal control terminal V2, and the input signal of the fourth signal control terminal V4 are all at a high level.

As shown in FIG. 5B, the first switching transistor T1, the second switching transistor T2, and the fourth switching transistor T4 are turned on, and the third switching transistor T3 is turned off. Under the control of the first signal control terminal V1, the signal of the data signal terminal Data is supplied to the first node a. At this time, the potential $V_a$ of the first node a is 0. Under the control of the fourth signal control terminal V4, the signal of the second power source terminal VSS is provided to the third node c. At this time, the potential $V_c$ of the third node is $V_c=V_{ss}$. At this stage, the capacitor Cs starts to discharge until the potential $V_b$ of the second node b is $V_b=V_{th}$. Since the second switching transistor T2 is turned on, the potential $V_d$ of the fourth node d is $V_d=V_b=V_{th}$. At this time, the driving transistor DTFT is turned off.

In this stage, during the discharge of the capacitor Cs, since the fourth switching transistor T4 is turned on, the organic light emitting diode OLED is short-circuited. Therefore, the discharge speed of the capacitor is improved, and the accuracy of the threshold voltage detection is ensured.

The third stage S3, that is, the writing stage: the input signal of the first signal control terminal V1 and the input signal of the data signal terminal Data are both at a high level.

As shown in FIG. 5C, the second switching transistor T2, the third switching transistor T3, and the fourth switching transistor T4 are turned off, the first switching transistor T1 is turned on. The potential $V_a$ of the first node a is jump to $V_a=V_{data}$ under the control of the data signal terminal Data. Under the bootstrap action of the capacitor Cs, the potential $V_b$ of the second node b jumps to $V_b=V_{th}+V_{data}$. At this time, the potential $V_c$ of the third node c is $V_c=V_b=V_{th}+V_{data}$.

The fourth stage S4, that is, the light-emitting stage: the input signal of the third signal control terminal V3 is at a high level.

As shown in FIG. 5D, the first switching transistor T1, the second switching transistor T2, and the fourth switching transistor T4 are turned off, the third switching transistor T3 is turned on, and the driving transistor DTFT is turned on under the action of the second node b. Under the control of the third signal control terminal V3, a driving current for driving the organic light emitting diode OLED is transmitted from the fourth node d to the third node c.

In this stage, the gate voltage $V_G$ of the driving transistor DTFT is $V_G=V_b=V_{th}+V_{data}$, and the source voltage $V_s$ is equal to the potential of the third node c, that is, the potential $V_{OLED}$ at the anode of the organic light emitting diode OLED.

According to the current formula when the driving transistor DTFT is saturated, the driving current $I_{OLED}$ flowing through the light emitting element satisfies $$I_{OLED} = K(V_{GS} - V_{th})^2$$
$$= K(V_{th} + V_{data} - V_{OLED} - V_{th})^2$$
$$= K(V_{data} - V_{OLED})^2$$

Wherein K is a fixed constant related to the process parameters and geometric dimensions of the driving transistor DTFT, $V_{GS}$ is the difference of the voltages between gate and source electrode of the driving transistor DFTF, and $V_{th}$ is the threshold voltage of the driving transistor DFTF.

According to the description of the working principle of the pixel driving circuit provided by the embodiment of the present disclosure, in the reset stage, since the fourth switching transistor T4 is turned on, the third node c can be accurately reset to the low level of the second power source terminal VSS. In the threshold detection stage, since the fourth switching transistor T4 is turned on, the organic light emitting diode is short-circuited, the discharge speed is increased, and the accuracy of the threshold voltage detection is also ensured.

It can be seen from the derivation result of the above current formula that in the light-emitting stage, the driving current outputted by the driving transistor DTFT is not affected by the threshold voltage of the driving transistor DTFT and the voltage at the anode of the organic light emitting diode OLED, and is only related to the signal on the data signal terminal. Accordingly, the influence of the threshold voltage of the driving transistor DTFT on the driving current is eliminated, thereby ensuring uniform display brightness of the display apparatus and improving the display effect of the entire display apparatus.

In this embodiment, in the reset stage, the input signal of the first signal control terminal V1, the input signal of the second signal control terminal V2, the input signal of the third signal control terminal V3, the input signal of the fourth signal control terminal V4 and the input signal of the first power source terminal VDD are all at a high level. The input signal of the data signal terminal Data and the input signal of the second power source terminal VSS are both at a low level. In the threshold detection stage, the input signal of the first signal control terminal V1, the input signal of the second signal control terminal V2, the input signal of the fourth signal control terminal V4, and the input signal of the first power source terminal VDD are all at a high level. The input signal of the third signal control terminal V3, the input signal of the data signal terminal Data and the input signal of the second power source terminal VSS are all at a low level. In the writing stage, the input signal of the first signal control terminal V1, the input signal of the data signal terminal Data, and the input signal of the first power source terminal VDD are all at a high level. The input signal of the second signal control terminal V2, the input signal of the third signal control terminal V3, the input signal of the fourth signal control terminal V4, and the input signal of the second power source terminal VSS are all at a low level. In the light emitting stage, the input signal of the third signal control terminal V3 and the input signal of the first power source terminal VDD are both at a high level, the input signal of the first signal control terminal V1, the input signal of the second signal control terminal V2, the input signal of the fourth signal control terminal V4, the input signal of the data signal terminal Data, and the input signal of the second power source terminal VSS are all at a low level.

The pixel driving circuit provided by the embodiment of the present disclosure includes: a first control sub-circuit, a second control sub-circuit, a third control sub-circuit, an energy storage sub-circuit, and a driving sub-circuit; a light emitting element is connected to a third node and a second power source terminal, respectively; the first control sub-circuit is respectively connected to a data signal terminal, a first signal control terminal and a first node, and is configured to provide the signal of the data signal terminal to the first node under the control of the first signal control terminal; the second control sub-circuit is respectively connected to a second node, a fourth node, a second signal control terminal, a third signal control terminal, and the first power source terminal, and is configured to provide signal of first power source terminal to fourth node under the control of the third signal control terminal, and is further configured to provide a signal of the fourth node to a second node under the control of the second signal control terminal; the third control sub-circuit is respectively connected to a third node, a fourth signal control terminal and the second power source terminal, and is configured to provide a signal of the second power source terminal to the third node under the control of the fourth signal control terminal; the energy storage sub-circuit is respectively connected to the first node and the second node, and is configured to store a potential difference between the first node and the second node; the driving sub-circuit is respectively connected to the second node, the third node and the fourth node, and is configured to transmit, from the fourth node to the third node, a driving current for driving the light emitting element under the control of the second node. In the embodiment of the present disclosure, the signal of the second power source terminal is provided to the third node by the third control sub-circuit in the threshold detection stage, short-circuiting the light emitting element, eliminating the technical problems associated with the parasitic capacitance of the light emitting element that the result of the threshold voltage detection is not accurate and the detection time is too long, improving the accuracy of the result of the threshold detection and reduces the time required for the threshold voltage detection.

Figure 6:
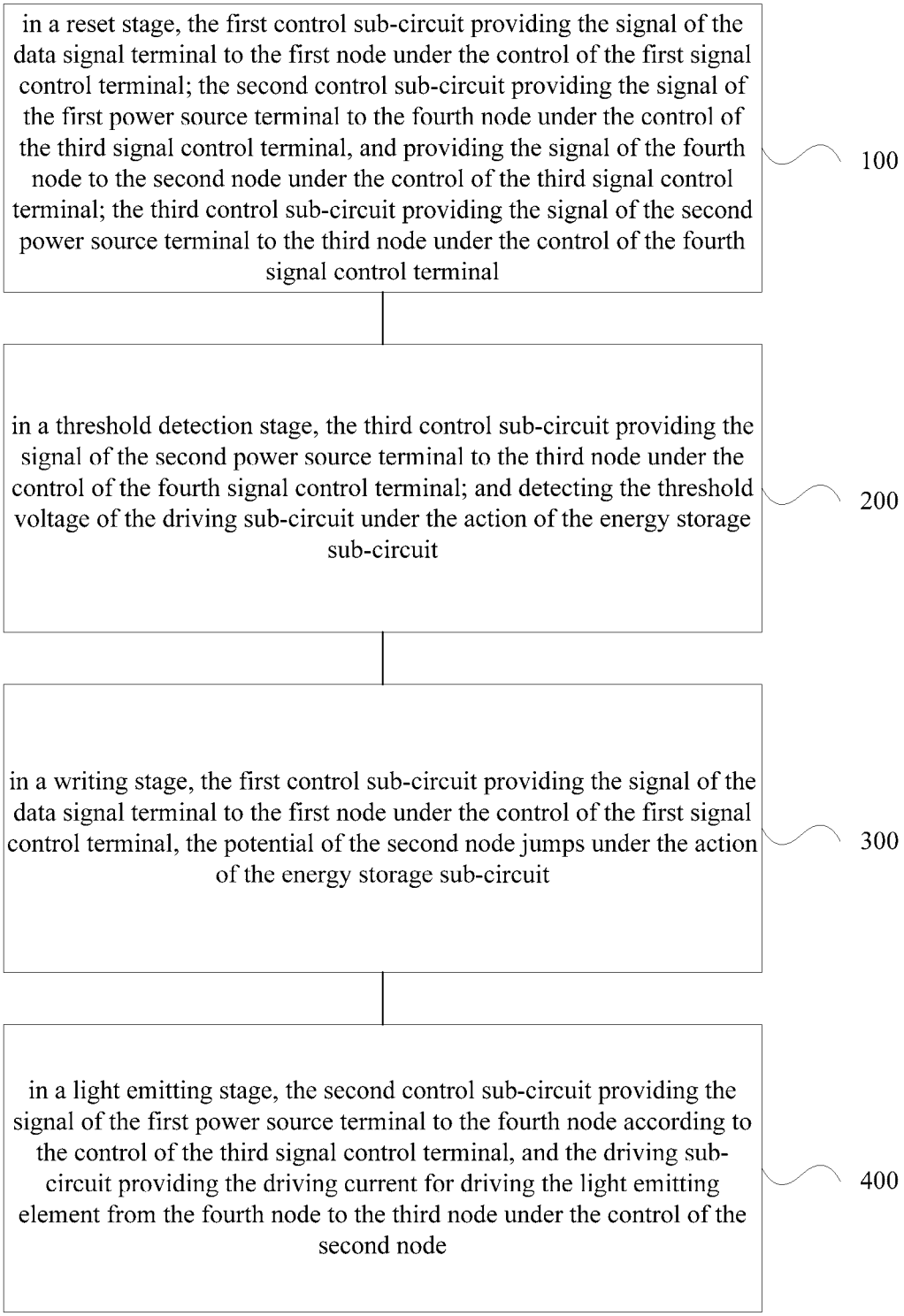
FIG. 6 is a flow chart of a pixel driving method according to some embodiments of the present disclosure.

Based on the disclosed concept of the above embodiments, FIG. 6 is a flowchart of a pixel driving method according to an embodiment of the present disclosure. As shown in FIG. 6, the pixel driving method as provided by the embodiment of the present disclosure is implemented with the above pixel driving circuit according to the embodiment of the present disclosure, and specifically includes following steps.

Step 100: In the reset stage, the first control sub-circuit provides the signal of the data signal terminal to the first node under the control of the first signal control terminal; the second control sub-circuit provides the signal of the first power source terminal to the fourth node under the control of the third signal control terminal, and provides the signal of the fourth node to the second node under the control of the third signal control terminal; the third control sub-circuit provides the signal of the second power source terminal to the third node under the control of the fourth signal control terminal.

In this stage, the input signal of the first signal control terminal, the input signal of the second signal control terminal, the input signal of the third signal control terminal, and the input signal of the fourth signal control terminal are all at a high level, and the input signal of the data signal terminal is at a low level. Optionally, the low level can be zero.

Step 200: in the threshold detection stage, the third control sub-circuit provides the signal of the second power source terminal to the third node under the control of the fourth signal control terminal; and detects the threshold voltage of the driving sub-circuit under the action of the energy storage sub-circuit.

Specifically, the step of detecting the threshold voltage of the driving sub-circuit under the action of the energy storage sub-circuit includes: the energy storage sub-circuit adjusts the potential of the second node by discharging until the potential of the second node is equal to the threshold voltage of the driving transistor in the driving sub-circuit.

In this stage, the input signal of the first signal control terminal, the input signal of the second signal control terminal, and the input signal of the fourth signal control terminal are all at a high level, and the input signal of the third signal control terminal and the input signal of the data signal terminal are both at a low level. It should be noted that, in this stage, the potential of the fourth node is equal to the potential of the second node.

Step 300: in the writing stage, the first control sub-circuit provides the signal of the data signal terminal to the first node under the control of the first signal control terminal, and the potential of the second node jumps under the action of the energy storage sub-circuit.

In this stage, the input signal of the first signal control terminal and the input signal of the data signal terminal are both at a high level, and the input signal of the second signal control terminal, the input signal of the third signal control terminal, and the input signal of the fourth signal control terminal are all at a low level.

Step 400: In the light emitting stage, the second control sub-circuit provides the signal of the first power source terminal to the fourth node according to the control of the third signal control terminal, and the driving sub-circuit provides, from the first node to the third node, the driving current for driving the light emitting element under the control of the second node.

At this stage, the input signal of the third signal control terminal is at a high level, and the input signal of the first signal control terminal, the input signal of the second signal control terminal, the input signal of the fourth signal control terminal, and the input signal of the data signal terminal are all at a low level.

The pixel driving method according to the embodiment of the present disclosure, includes: in a resetting stage, the first control sub-circuit provides the signal of the data signal terminal to the first node under the control of the first signal control terminal; the second control sub-circuit provides the signal of the first power source terminal to the fourth node under the control of the third signal control terminal, and provides the signal of the fourth node to the second node under the control of the third signal control terminal; the third control sub-circuit provides the signal of the second power source terminal to the third node under the control of the fourth signal control terminal; in the threshold detection stage, the third control sub-circuit provides the signal of the second power source terminal to the third node under the control of the fourth signal control terminal; under the action of the energy storage sub-circuit, detecting a threshold voltage of the driving sub-circuit; in the writing stage, the first control sub-circuit provides the signal of the data signal terminal to the first node under the control of the first signal control terminal, and the potential of the second node jumps under the action of the energy storage sub-circuit; in the light emitting stage, the second control sub-circuit provides the signal of the first power source terminal to the fourth node according to the control of the third signal control terminal, the driving sub-circuit provides a driving current for driving the light-emitting element from the fourth node to the third node under the control of the second node. In the present embodiment, the third control sub-circuit provides the signal of the second power source terminal to the third node at the threshold detection stage. The light-emitting element is short-circuited, eliminating the technical problem associated with the parasitic capacitor of the light emitting element that the result the threshold voltage detection is not accurate and the detection time is too long. The accuracy of the result of the threshold detection is improved, and the time required for threshold voltage detection is reduced.

Based on the above disclosed concept, an embodiment of the present disclosure further provides a display apparatus including a pixel driving circuit.

The pixel driving circuit is a pixel driving circuit as provided according to an embodiment of the present disclosure, and the implementation principle and effect thereof are similar, and details are not repeated.

The display apparatus may include a display substrate, and the pixel driving circuit may be disposed on the display substrate. Preferably, the display apparatus may be any product or component having a display function such as an OLED panel, a mobile phone, a tablet, a television, a display, a laptop computer, a digital photo frame, a navigator, etc.

In some embodiments according to the present disclosure, the display substrate of the display apparatus may adopt a Low Temperature Poly-silicon (LTPS) process, and the design of the plurality of transistors and the plurality of capacitors does not affect the aperture ratio of the module.

It should be noted that, according to some embodiments of the present disclosure, the display substrate of the display apparatus may also adopt an amorphous silicon process. It should be noted that, according to some embodiments of the present disclosure, the pixel driving circuit may employ a thin film transistor of a process of amorphous silicon, polysilicon, oxide, or the like.

According to some embodiments of the present disclosure, the type of the thin film transistor employed by the pixel driving circuit may be changed according to actual needs. Moreover, although the above description has been made by taking an active matrix organic light emitting diode as an example, the present disclosure is not limited to a display substrate using an active matrix organic light emitting diode, and can also be applied to a display substrate using other various light emitting diodes.

The embodiments disclosed in the present disclosure are as described above, but are merely used to facilitate the understanding of the present disclosure, and are not intended to limit the present disclosure. Any modification or variation in the form and details of the implementation may be made by those skilled in the art without departing from the spirit and scope of the disclosure. The protection scope of the present disclosure is defined by the appended claims.

What is claimed is:

1. A pixel driving circuit for driving a light emitting element, comprising:

a first controller configured to provide a signal of a data signal terminal to a first node under the control of a first signal control terminal;

a second controller configured to provide a signal of a first power source terminal to a fourth node under the control of a third signal control terminal, and to provide a signal of the fourth node to a second node under the control of a second signal control terminal;

a third controller configured to provide a signal of a second power source terminal to a third node under the control of a fourth signal control terminal, so that the light emitting element is short circuited in a threshold detection stage;

an energy storage configured to store a potential difference between the first node and the second node; and a driver configured to transmit a driving current for driving the light emitting element from a fourth node to the third node under the control of the second node, wherein in a resetting stage, an input signal of the first signal control terminal, an input signal of the second signal control terminal, an input signal of the third signal control terminal, and an input signal of the fourth signal control terminal are all at a high level; in the threshold detection stage, the input signal of the first signal control terminal, the input signal of the second signal control terminal and the input signal of the fourth signal control terminal are all at the high level; in a writing stage, the input signal of the first signal control terminal and the input signal of the data signal terminal are both at the high level; in a light emitting stage, the input signal of the third signal control terminal is at the high level.

2. The pixel driving circuit of claim 1, wherein the first controller comprises:

a first switching transistor, and a gate electrode of the first switching transistor is connected to the first signal control terminal, a first electrode of the first switching transistor is connected to the data signal terminal, and a second electrode of the first switching transistor is connected to the first node.

3. The pixel driving circuit of claim 2, wherein the second controller comprises:

a second switching transistor and a third switching transistor, a gate electrode of the second switching transistor is connected to the second signal control terminal, a first electrode of the second switching transistor is connected to the second node, and a second electrode of the second switching transistor is connected to the fourth node, and a gate electrode of the third switching transistor is connected to the third signal control terminal, a first electrode of the third switching transistor is connected to the first power source terminal, and a second electrode of the third switching transistor is connected to the fourth node.

4. The pixel driving circuit of claim 3, wherein the third controller comprises:

a fourth switching transistor, and a gate electrode of the fourth switching transistor is connected to the fourth signal control terminal, a first electrode of the fourth switching transistor is connected to the third node, and a second electrode of the fourth switching transistor is connected to the second power source terminal.

5. The pixel driving circuit of claim 4, wherein the energy storage comprises:

a capacitor, and one terminal of the capacitor is connected to the first node, and another terminal of the capacitor is connected to the second node.

6. The pixel driving circuit of claim 5, wherein the driver comprises:

a driving transistor, and a gate electrode of the driving transistor is connected to the second node, a source electrode of the driving transistor is connected to the third node, and a drain electrode of the driving transistor is connected to the fourth node.

7. The pixel driving circuit of claim 6, wherein the capacitor is configured to adjust a potential of the second node by discharging until the potential of the second node is equal to a threshold voltage of the driving transistor.

8. The pixel driving circuit according to claim 6, wherein the first switching transistor, the second switching transistor, the third switching transistor, the fourth switching transistor, and the driving transistor are all N-type thin film transistors or P-type thin film transistors.

9. The pixel driving circuit according to claim 1, wherein the light emitting element is an organic light emitting diode.

10. A display apparatus comprising the pixel driving circuit according to claim 1.

11. A pixel driving method for a pixel driving circuit according to claim 1, comprising:

in a reset stage, the first controller providing the signal of the data signal terminal to the first node under the control of the first signal control terminal; the second controller providing the signal of the first power source terminal to the fourth node under the control of the third signal control terminal, and providing the signal of the fourth node to the second node under the control of the third signal control terminal; the third controller providing the signal of the second power source terminal to the third node under the control of the fourth signal control terminal;

in the threshold detection stage, the third controller providing the signal of the second power source terminal to the third node under the control of the fourth signal control terminal; and detecting a threshold voltage of the driver under an action of the energy storage;

in a writing stage, the first controller providing the signal of the data signal terminal to the first node under the control of the first signal control terminal; and in a light emitting stage, the second controller providing the signal of the first power source terminal to the fourth node according to the control of the third signal control terminal, and the driver providing the driving current for driving the light emitting element from the fourth node to the third node under the control of the second node.

12. The method of claim 11, wherein the step of detecting the threshold voltage of the driver under the action of the energy storage comprises:

the energy storage adjusts a potential of the second node by discharging until the potential of the second node is equal to the threshold voltage of a driving transistor in the driver.

13. The method of claim 12, wherein in the threshold detection stage, the potential of the fourth node is equal to the potential of the second node.

* * * * *